US009168205B2

(12) United States Patent
Moss

(10) Patent No.: US 9,168,205 B2
(45) Date of Patent: Oct. 27, 2015

(54) GASTROINTESTINAL FEEDING AND ASPIRATION CATHETER

(71) Applicant: Gerald Moss, White Plains, NY (US)

(72) Inventor: Gerald Moss, White Plains, NY (US)

( * ) Notice: Subject to any disclaimer, the term of this patent is extended or adjusted under 35 U.S.C. 154(b) by 92 days.

(21) Appl. No.: 14/051,884

(22) Filed: Oct. 11, 2013

(65) Prior Publication Data

US 2015/0105717 A1 Apr. 16, 2015

(51) Int. Cl.
*A61J 15/00* (2006.01)

(52) U.S. Cl.
CPC ..... *A61J 15/0069* (2013.01); *A61J 15/00* (2013.01); *A61J 15/0015* (2013.01); *A61J 15/0073* (2013.01); *A61J 15/0096* (2013.01)

(58) Field of Classification Search
CPC ..... A61J 15/0069; A61J 15/0073; A61J 15/0096; A61J 15/00; A61J 15/0026; A61J 15/0015; A61M 2039/085
USPC ..... 604/910
See application file for complete search history.

(56) References Cited

U.S. PATENT DOCUMENTS

| | | | | |
|---|---|---|---|---|
| 4,543,089 | A | 9/1985 | Moss | |
| 5,832,920 | A * | 11/1998 | Field | 128/207.14 |
| 6,447,472 | B1 * | 9/2002 | Moss | 604/27 |
| 6,949,092 | B1 | 9/2005 | Moss | |
| 2005/0171468 | A1 | 8/2005 | Wood | |
| 2012/0283627 | A1 | 11/2012 | Moss | |

* cited by examiner

*Primary Examiner* — Nicholas Lucchesi
*Assistant Examiner* — Anh Bui
(74) *Attorney, Agent, or Firm* — Schmeiser, Olsen & Watts LLP

(57) ABSTRACT

A gastrointestinal catheter having feeding and suction channels in close proximity. The gastrointestinal catheters may have a controlled leak via a recirculation feature.

14 Claims, 4 Drawing Sheets

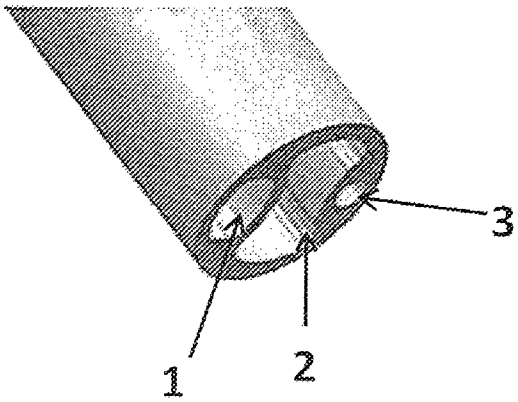
Figure #1

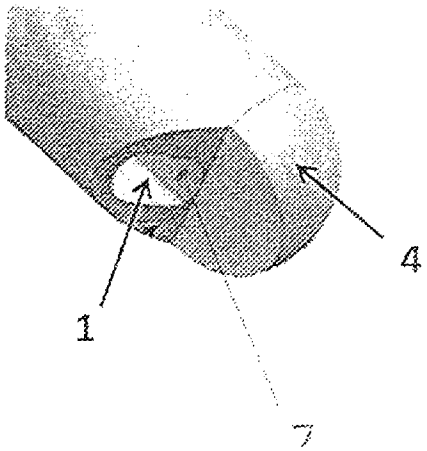
Figure #2

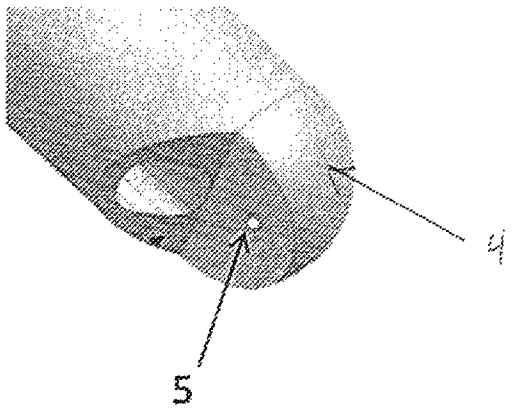
Figure #3

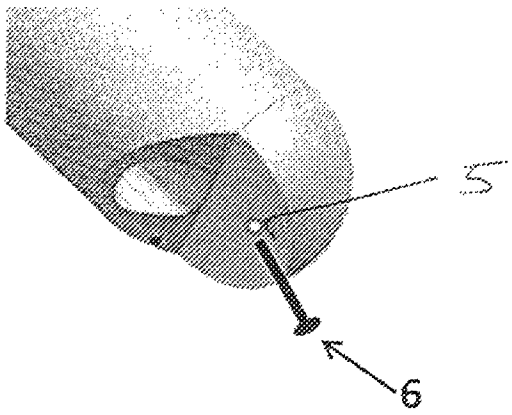
Figure #4

GASTROINTESTINAL FEEDING AND ASPIRATION CATHETER

BACKGROUND OF THE INVENTION

Physicians use feeding-decompression catheters to feed distally and aspirate proximally. All such catheters in current use have the feeding and aspiration sites separated by at least about three inches to prevent unwanted permanent removal of some or all of the feedings.

U.S. Pat. No. 4,543,089 discloses a feeding-decompression device, wherein the aspiration channel has aspiration orifices located in both the stomach and the proximal small intestine. The feeding channel terminates more distally within the same segment of small intestine. While increasing the efficiency of fluid removal within the stomach and intestine, the feeding-decompression device requires sufficient separation, approximately three inches, between the feeding site and the closest aspiration orifice, lest feedings be removed inadvertently. The aspirated fluids that are removed from the patient are discarded.

U.S. Pat. No. 6,447,472 discloses a device which aspirates digestive fluids via a decompression channel of a feeding-decompression catheter, and returns it to the patient via the feeding channel. This prevents unnecessary loss of body fluids, which also contain digestive enzymes, electrolytes, and protective antibodies. In recycling, the aspirate again traverses both the feeding and aspiration channels, providing the added benefit of cleansing these channels of material that tends to obstruct these channels.

It has now been found that by providing a "controlled leak" between the aspiration and feeding channels, the volume of digestive juices recirculating can be increased, thereby enhancing the cleansing effect. This additional aspiration fluid is fully returned to the patient without additional loss.

DISCLOSURE OF THE INVENTION

The present invention relates to a gastrointestinal feeding and aspirating device, comprising: an aspirating channel having an external end portion to be disposed outside a patient's body, said external end portion having an opening for connection to a source of suction, and having an internal end portion to be disposed in the patient's stomach and extending into a proximal segment of duodenum, said internal end portion having orifices for intake of matter to be removed from the body; and a feeding channel having an external end portion to be disposed outside the body, said external end portion having an opening adapted to receive liquid food and recycled aspirate to be transported through the channel, and having an internal end portion to be disposed in the proximal segment of the duodenum, said internal end portion having an orifice therein for the discharge of food at the device distal end, said feeding channel further having a pinhole channel leading to the aspiration channel, in close proximity to the feeding channel internal end portion, whereby said pinhole channel is of a size to provide a flow of recirculated digestive juices in the range of between about 20 ml/minute to about 50 ml/minute between the aspiration channel and the feeding channel.

The present invention also relates to a gastrointestinal feeding and aspirating device, comprising: an aspirating channel having an external end portion to be disposed outside a patient's body, said external end portion having an opening for connection to a source of suction, and having an internal end portion to be disposed in the patient's stomach and proximal segment of duodenum, said internal end portion having orifices for intake of matter to be discharged from the body; and a feeding channel having an external end portion to be disposed outside the body, said portion having an opening adapted to receive liquid food and recycled aspirate to be transported through the channel, and having an internal end portion to be disposed in the proximal segment of the duodenum, said internal end portion having an orifice therein for the discharge of food at the device distal end, said feeding channel further having a pinhole channel leading to the aspiration channel, opening in close proximity to the feeding channel internal end portion, whereby said pinhole channel has an inner diameter in the range of from about 0.0005 inches to about 0.001 inches.

The automatic control system of the present invention reintroduces the aspirate into the feeding channel to join the stream of feedings, which results in continuous enzymatic cleansing of both the feeding and aspiration channels. These recirculating digestive enzymes can effectively keep both the feeding and aspiration channels open. To increase the volume of recirculated digestive juices and optimize this cleansing effect, a "controlled leak," is provided between the aspiration channel and the feeding channel. This additional aspirated fluid is fully returned to the patient without loss.

The foregoing and other features and advantages of the present invention will be apparent from the following more detailed description of the particular embodiments of the invention, as illustrated in the accompanying drawings.

BRIEF DESCRIPTION OF THE DRAWINGS

FIG. 1 is a cross-section view of a feeding-decompression balloon catheter in accordance with the present invention.

FIG. 2 shows a molded or formed plug at the terminal end of the catheter that occludes the aspiration and balloon channels and allows free outflow from the feeding channel, in accordance with the present invention.

FIG. 3 shows a pinhole channel drilled from the plug into the aspiration channel, in accordance with the present invention.

FIG. 4 shows a nylon pin for closure of the pinhole channel, in accordance with the present invention.

DETAILED DESCRIPTION OF EMBODIMENTS OF THE INVENTION

Physicians use feeding-decompression catheters to feed distally and aspirate proximally. They all have the feeding and aspiration sites separated by more than three inches to prevent unwanted removal of some or all of the feedings. Feeding-decompression catheters must reside within the gastrointestinal (G-I) tract of patients for prolonged periods.

A catheter may be delivered by direct penetration through the abdominal and gastric or intestinal walls. Some directly placed catheters may then be directed to traverse the normal G-I channels to reach a more distal duodenal or jejunal feeding and/or aspiration site.

Alternatively, the catheter may be introduced indirectly and less traumatically into the body through a natural opening (e.g., nasal passage), to then traverse the natural G-I channels to the gastric or intestinal feeding and/or aspiration site.

In the present invention a gastrointestinal feeding and aspirating device is disclosed. The G-I device comprises an aspirating channel having an external end portion to be disposed outside a patient's body, said external end portion having an opening for connection to a source of suction, and having an internal end portion to be disposed in the patient's stomach and proximal segment of duodenum, said internal end portion having large orifices for intake of matter to be discharged from the body and located between the stomach and up to about 3 inches proximal to the device distal tip.

The G-I device also comprises a feeding channel having an external end portion to be disposed outside the body, said external end portion having an opening adapted to receive liquid food and recycled aspirate to be transported through the channel, and having an internal end portion to be disposed in the more distal segment of the duodenum, said internal end portion having an orifice therein for the discharge of food at the device distal end.

In addition, there is a pinhole size channel opening adjacent the feeding channel internal end portion terminus, whereby said pinhole channel is of a size to provide a flow of recirculated digestive juices in the range of between about 20 ml/minute to about 50 ml/minute between the feeding channel's outflow and the aspiration channel. The device is secured to the patient's body through abdominal and gastric walls such that the internal end portion of each channel is located in the stomach and proximal segment of the duodenum, said feeding channel orifice being maintained at a location which is about three inches downstream of the most distal aspirating channel large orifice, the portion of each channel between the securing means and that channel's external opening being continuous.

The automatic control system of the present invention reintroduces the aspirate with the flowing feeding solution into the feeding channel, so that a minimum volume of this body fluid and its contained enzymes, electrolytes, and protective antibodies is permanently lost from the patients. Additionally, the recirculated digestive enzymes can effectively flush and cleanse the catheter channels, which are prone to obstruction. The feeding decompression catheter of the present invention increases the volume of such aspirate to be refed, without increasing the loss from the patient of either feedings or digestive fluids.

To optimize this self-cleansing action, the volume of aspirate that would repeatedly recirculate through the feeding and aspiration channels is maximized. A "controlled leak" or temporary removal (discharge) in the range of about 20 ml/minute to about 50 ml/minute, generally about 30 ml/minute, analogous to an arteriovenous (AV) fistula, between the distal feeding channel and the suction channel is produced.

The automatic control system of the present invention refeeds the aspirate, which results in continuous enzymatic cleansing of both the feeding and aspiration channels. Approximately 90% of the delivered fluid (feedings plus aspirate) will be repeatedly aspirated to recirculate during each 30 second cycle. All the digestive secretions, approximately four liters/day, are removed from the proximal duodenum, and then returned via the feeding channel. This recycling repeats about every 30 seconds, until the entire aspirate has been permanently returned. Only about 10% of normal peristalsis is required for total propulsion and absorption of secretions and tube feedings. Until that degree of postoperative recovery has been attained, which is generally less than about two hours, all of the excess inflow is permanently discarded. This discarded excess inflow generally does not exceed about 200 ml/day.

Almost all of the patient's total production of digestive juices, including protective secretory globulins, remains with the patient. The feeding decompression catheter of the present invention increases the volume of such aspirate to be refed, without increasing the loss to the patient of either feedings or digestive fluids.

In one embodiment, a vacuum pump or central vacuum source can be connected to the feeding channel to draw and refed the aspirate into the feeding channel, as described in U.S. Pat. No. 6,949,092, the contents of which are incorporated herein by reference.

The large aspiration orifices (about 2 mm) in the present invention extend generally between the stomach to within about 3 inches of the delivery site. A controlled leak or pinhole channel opens in close proximity to the delivery site extending to the aspiration channel, generally in the range of about 1.0 mm or less, to remove an additional limited volume for recycling.

Producing a controlled leak between the feeding outflow and suction channels provides a larger and more certain volume for recirculating. A suitable additional volume is about one half the capacity of the aspirate collection chamber.

A controlled leak is produced between the feeding and suction or aspiration channels provides a larger volume for recycling. A suitable volume is about one half the capacity of the suction chamber. Generally, the volume of a typical aspirate collection chamber is in the range of from about 30 ml to about 50 ml.

In the gastrointestinal device of the present invention, the pinhole channel for the controlled leak is initially blocked, for example, with a pin, so it can operate as a traditional catheter. The user planning to use the control system of the present invention simply removes the pin.

The pinhole channel is drilled through the intervening plastic of the formed or molded plug at the tip of the device and into the suction (aspiration channel). A removable pin is inserted. Alternatively, a small hole may be punched between the feeding and aspiration channels near their internal ends to create the controlled leak. The pinhole channel is drilled into the aspiration channel with the other opening of the channel within about 1 mm of the feeding channel internal end portion terminus.

As shown in FIG. 1, a gastrointestinal tube (catheter) is extruded with three channels 1, 2 and 3. The largest channel is hour-glass shaped channel 2 for suction. The next largest channel is the feeding channel 1 which will open at the very distal end of the catheter. The smallest channel 3 is to inflate a balloon. The device may also be manufactured without a balloon, wherein the tube is extruded with only two channels.

In FIG. 2 the terminal openings of feeding channel 1 is exposed, and the terminal opening of aspiration channel 2 and balloon inflation channel 3 are occluded. A small pinhole channel 7 may be punched between the feeding channel 1 and the aspiration channel 2 to create the controlled leak. The pinhole channel 7 is small, generally having an I.D. of about 0.001 inches or less.

A solid (formed or molded) plug 4 may be inserted and cemented into aspiration channel 2, also blocking balloon inflation channel 3, when present. Alternatively, the solid plug 4 may be formed, by adding additional plastic while the extruded tubing is contained within a mold.

FIG. 3 shows a small pinhole channel 5 which may be drilled through the solid plug 4 into the lumen of the aspiration channel 2. The pinhole channel 5 is small, generally having an I.D. of about 0.001 inches or less.

FIG. 4 shows a pin 6 for closure of pinhole channel 5. Pin 6 may be made of nylon. The gastrointestinal tube of the present invention may be manufactured with the pinhole channel initially blocked, so it can be used like a more standard catheter. The user planning to use the control system of the present invention simply removes the pin 6. Pin 6 may also be used for closure of pinhole channel 7 in FIG. 2.

Pin 6 is removable by a physician prior to a procedure if the physician wants to utilize the recirculation feature of the present invention. Pinhole channel 5 is drilled through the plug 4 at the end of the catheter into the suction (aspiration) channel 2. The size of pinhole channel 5 is determined empirically. Generally, the pinhole channel has an inner diameter in the range of from about 0.0005 inches to about 0.001 inches particularly about 0.001 inches. With the pressure gradient at operating conditions for the patient of approximately 50 mm Hg, the controlled leak through pinhole channel 5 during the 30 seconds of a cycle will be about 15 ml, which is half the capacity of the aspirate collection chamber.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A gastrointestinal feeding and aspirating device, comprising:

an aspirating channel having an external end portion to be disposed outside a patient's body, said external end portion having an opening for connection to a source of suction, and having an internal end portion to be disposed in the patient's stomach and extending into a proximal segment of duodenum, said internal end portion having orifices for intake of matter to be removed from the body; and a feeding channel having an external end portion to be disposed outside the body, said external end portion having an opening adapted to receive liquid food to be transported through the channel, and having an internal end portion to be disposed in the proximal segment of the duodenum, said internal end portion having an orifice therein for the discharge of food at the device distal end, said feeding channel further having a pinhole channel leading to the aspiration channel, opening in close proximity to the feeding channel internal end portion, wherein the pinhole channel has an inner diameter in the range of from about 0.0005 inches to about 0.001 inches and a removable pin in the pinhole channel, whereby said pinhole channel is of a size to provide a flow of recirculated digestive juices in the range of between about 20 ml/minute to about 50 ml/minute between the aspiration channel and the feeding channel.

2. The device of claim 1 wherein the flow of recirculated digestive juices is about 30 ml/minute between the feeding and aspirating channels.

3. The device of claim 1 wherein aspirate is reintroduced with feeding solution via the feeding channel, and further wherein recirculating digestive enzymes keep both aspirating and feeding channels open.

4. The device of claim 1 having the pinhole channel drilled into the aspiration channel and opening within about 1 mm of the feeding channel internal end portion terminus.

5. The device of claim 1 wherein the pinhole channel has an inner diameter of about 0.001 inches.

6. The device of claim 1 wherein the removable pin is made of nylon.

7. The device of claim 1 having the pinhole channel drilled through a plug at the aspiration channel internal end portion terminus, the pinhole channel terminating within 1 mm beyond the feeding channel internal end portion terminus.

8. A gastrointestinal feeding and aspirating device, comprising:

an aspirating channel having an external end portion to be disposed outside a patient's body, said external end portion having an opening for connection to a source of suction, and having an internal end portion to be disposed in the patient's stomach and extending into a proximal segment of duodenum, said internal end portion having orifices for intake of matter to be removed from the body; and a feeding channel having an external end portion to be disposed outside the body, said external end portion having an opening adapted to receive liquid food to be transported through the channel, and having an internal end portion to be disposed in the proximal segment of the duodenum, said internal end portion having an orifice therein for the discharge of food at the device distal end, said feeding channel further having a pinhole channel leading to the aspiration channel, opening in close proximity to the feeding channel internal end portion, wherein the pinhole channel is drilled through a plug at the aspiration channel internal end portion terminus, the pinhole channel terminating within 1 mm beyond the feeding channel internal end portion terminus, whereby said pinhole channel is of a size to provide a flow of recirculated digestive juices in the range of between about 20 ml/minute to about 50 ml/minute between the aspiration channel and the feeding channel.

9. The device of claim 8 wherein the flow of recirculated digestive juices is about 30 ml/minute between the feeding and aspirating channels.

10. The device of claim 8 wherein aspirate is reintroduced with feeding solution via the feeding channel, and further wherein recirculating digestive enzymes keep both aspirating and feeding channels open.

11. The device of claim 8 wherein the pinhole channel has an inner diameter in the range of from about 0.0005 inches to about 0.001 inches.

12. The device of claim 11 wherein the pinhole channel has an inner diameter of about 0.001 inches.

13. The device of claim 8 having a removable pin in the pinhole channel.

14. The device of claim 13 wherein the removable pin is made of nylon.

* * * * *